US011103111B1

(12) United States Patent
Huang

(10) Patent No.: US 11,103,111 B1
(45) Date of Patent: Aug. 31, 2021

(54) HAND DRYING APPARATUS WITH SQUEEZING AND DISPENSING ARRANGEMENT

(71) Applicant: Wei Huang, Irvine, CA (US)

(72) Inventor: Wei Huang, Irvine, CA (US)

( * ) Notice: Subject to any disclaimer, the term of this patent is extended or adjusted under 35 U.S.C. 154(b) by 46 days.

(21) Appl. No.: 16/806,971

(22) Filed: Mar. 2, 2020

(51) Int. Cl.
*A47K 10/26* (2006.01)
*A47K 10/32* (2006.01)
*A61H 7/00* (2006.01)

(52) U.S. Cl.
CPC ..... *A47K 10/26* (2013.01); *A47K 10/32* (2013.01); *A61H 7/001* (2013.01)

(58) Field of Classification Search
CPC ..... A47K 10/26; A47K 10/00; A47K 10/32; A61H 7/001
USPC ..... 34/90
See application file for complete search history.

(56) References Cited

U.S. PATENT DOCUMENTS 2,322,552 A * 6/1943 Sweetland ..... A47K 10/32 118/42
3,652,174 A * 3/1972 Boone ..... B65D 83/20 401/143
4,513,051 A * 4/1985 Lavash ..... A47K 10/00 428/212
5,459,944 A * 10/1995 Tatsutani ..... A47K 10/48 34/202
5,568,691 A * 10/1996 Rubin ..... A45D 20/30 34/98
5,762,710 A * 6/1998 Ngai ..... A47K 10/32 118/300
5,820,231 A * 10/1998 Schon ..... A47K 10/28 312/34.11
6,189,230 B1 * 2/2001 Huen ..... A47K 10/06 34/210
6,267,460 B1 * 7/2001 Gaide ..... A47K 10/28 312/34.11
6,613,144 B1 * 9/2003 Loertscher ..... A47K 10/32 118/302
6,745,975 B2 * 6/2004 Faulks ..... A47K 10/32 242/598.6
7,063,245 B2 * 6/2006 Faulks ..... A47K 10/32 225/27

(Continued)

FOREIGN PATENT DOCUMENTS

CA 2363744 C * 1/2010 ..... A47K 10/32
EP 3157401 B1 * 7/2019 ..... A47K 10/38
WO WO-2015195604 A1 * 12/2015 ..... B05B 11/0054

*Primary Examiner* — Stephen M Gravini
(74) *Attorney, Agent, or Firm* — Tsz Lung Yeung

(57) ABSTRACT

A hand drying apparatus includes an outer case and a squeezing and dispensing arrangement. The squeezing and dispensing arrangement includes a first supporting panel, a second supporting panel which is spacedly apart from the first supporting panel, and a plurality of driving rotors rotatably supported in the outer case for driving the fabric towel to move in a predetermined direction. The hand drying apparatus is operated between an idle mode and a drying mode, wherein in the idle mode, the first supporting panel and the second supporting panel are positioned and retained to space apart from each other, wherein in the drying mode, at least one of the first supporting panel and the second supporting panel is driven to move toward the other supporting panel for allowing the fabric sheet to contact with the user's hand.

24 Claims, 9 Drawing Sheets

(56) References Cited

U.S. PATENT DOCUMENTS

| | | | | |
|---|---|---|---|---|
| 7,774,953 | B1 * | 8/2010 | Duran | A47K 10/48 34/77 |
| 7,814,595 | B2 * | 10/2010 | Kafzan | A47K 10/30 8/151 |
| 8,490,291 | B2 * | 7/2013 | Churchill | A47K 10/48 34/90 |
| 8,607,472 | B2 * | 12/2013 | Ishii | A61L 2/24 34/526 |
| 8,813,383 | B2 * | 8/2014 | Liu | A47K 10/48 34/90 |
| 9,524,604 | B2 * | 12/2016 | Erb | A47K 10/28 |
| 10,696,821 | B2 * | 6/2020 | Heinzman | D04H 1/64 |
| 10,786,124 | B2 * | 9/2020 | Fujimura | A47K 10/48 |
| 10,863,872 | B2 * | 12/2020 | Borke | A47K 5/1207 |
| 2009/0031952 | A1 * | 2/2009 | Lazar | A47K 10/32 118/695 |
| 2009/0032636 | A1 * | 2/2009 | Orlandi | A47K 10/32 242/560.1 |

* cited by examiner

HAND DRYING APPARATUS WITH SQUEEZING AND DISPENSING ARRANGEMENT

BACKGROUND OF THE PRESENT INVENTION

Field of Invention

The present invention relates to a hand drying apparatus, and more particularly to a hand drying apparatus comprising a squeezing and dispensing arrangement which is capable of exerting pressure to a user's hand for drying thereof by a fabric sheet, such as a towel.

Description of Related Arts

Conventionally, there exist several kinds of hand drying apparatuses which are used for drying a user's hand. For example, some conventional drying apparatuses utilizes heated air for drying a user's hand. The disadvantages of this kind of hand drying apparatuses are that they need a considerable amount of power to operate. The electrical and mechanical components which are used to rapidly heat ambient air and blow the heated air to the user's hand consume a substantial amount of energy. Despite this, users' hands are not often dry enough to allow satisfactory users' experience.

Another kind of hand drying apparatus is disposable paper towel dispensers. An obvious disadvantage of this type of hand drying apparatuses is that they are not environmentally friendly. Paper towel dispensers consume a large amount of paper towels. A lot of paper towels are dispensed unnecessarily because users tend to require a new paper towel before the an existing one are thoroughly utilized. This produce a substantial amount of waste.

Another kind of hand drying apparatus is fabric towel dispensers. This type of hand drying apparatuses is different from the disposable paper towel dispensers mentioned above because it dispenses reusable fabric towels for users to dry their hands. A major disadvantage is that a user has to manually squeeze the fabric towel to allow effective absorption of water from the user's hand. When the fabric towels are used for an extended period of time, the fabric towels may deform and become hard to fit in the fabric towel dispensers for reuse. Used fabric towels may also be easily stuck in other components of the apparatus. Moreover, conventional hand drying apparatuses are not truly automatic because the users have to manually squeeze the dispensed fabric towel.

SUMMARY OF THE PRESENT INVENTION

Certain variations of the present invention provide a hand drying apparatus comprising a fabric sheet squeezing arrangement which is capable of automatically exerting pressure to a user's hand for drying thereof by a fabric sheet, such as a towel.

Certain variations of the present invention provide a hand drying apparatus comprising a squeezing and dispensing arrangement which may allow paper towel or fabric towel to press against a user's hand for absorbing moisture thereof. As such, it is not necessary for a user to manually squeeze the paper towel or fabric towel for drying his or her hands.

In one aspect of the present invention, it provides a hand drying apparatus for a fabric sheet used for absorbing moisture from a user's hand, the hand drying apparatus comprising:

an outer case; and a squeezing and dispensing arrangement, which comprises:

at least a first supporting panel and a second supporting panel provided in the outer case, the second supporting panel being provided in the outer case at a position spaced apart from the first supporting panel to form at least one drying cavity as a space formed between the first supporting panel and the second supporting panel for accommodating the user's hand; and at least one driving rotor rotatably supported in the outer case for driving the fabric sheet to move in a predetermined direction; and a plurality of supporting members provided in the outer casing and positioned to support the fabric sheet between the first supporting panel and the second supporting panel in a slidably movable manner;

the hand drying apparatus being operated between an idle mode and a drying mode, wherein in the idle mode, the first supporting panel and the second supporting panel are positioned and retained to space apart from each other, wherein in the drying mode, at least one of the first supporting panel and the second supporting panel is driven to move toward the other supporting panel for allowing the fabric sheet supported on the first supporting panel and the second supporting panel to contact with the user's hand in the drying cavity so as to absorb moisture from the user's hand.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Furthermore, "connected" may also mean direct connection or indirect connection, or connection through other auxiliary components. Therefore, the above terms should not be an actual connection limitation of the elements of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

Figure 1:
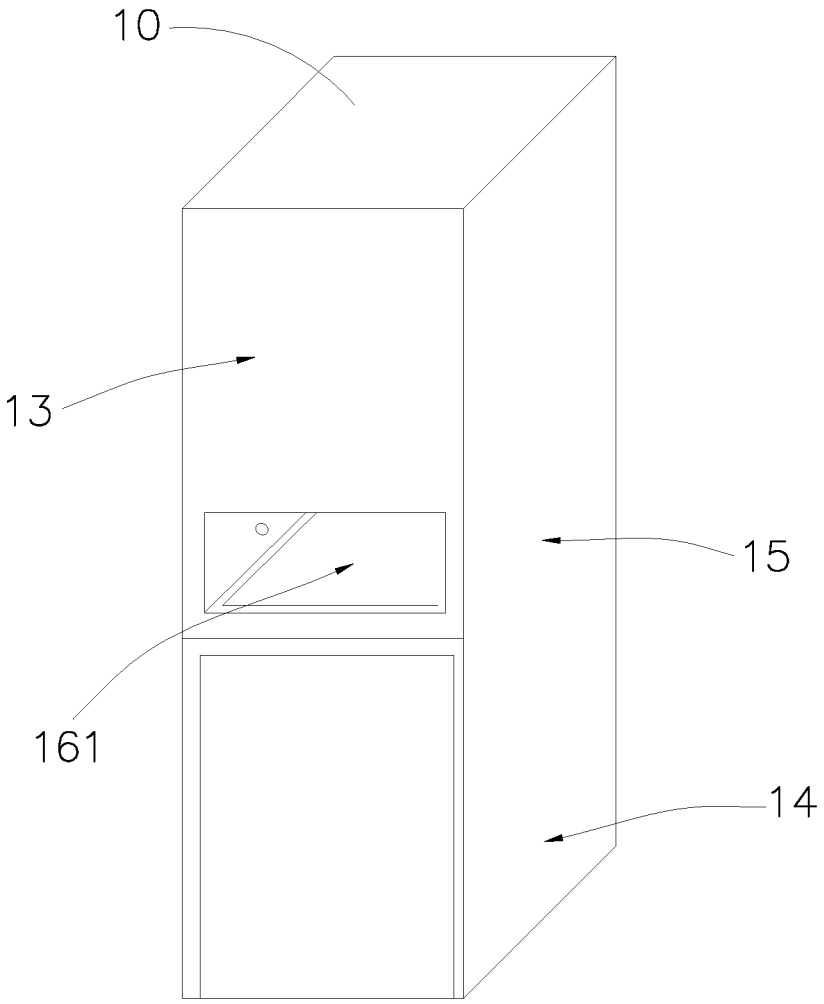
FIG. 1 is a perspective view of a hand drying apparatus according to a preferred embodiment of the present invention.
Figure 2:
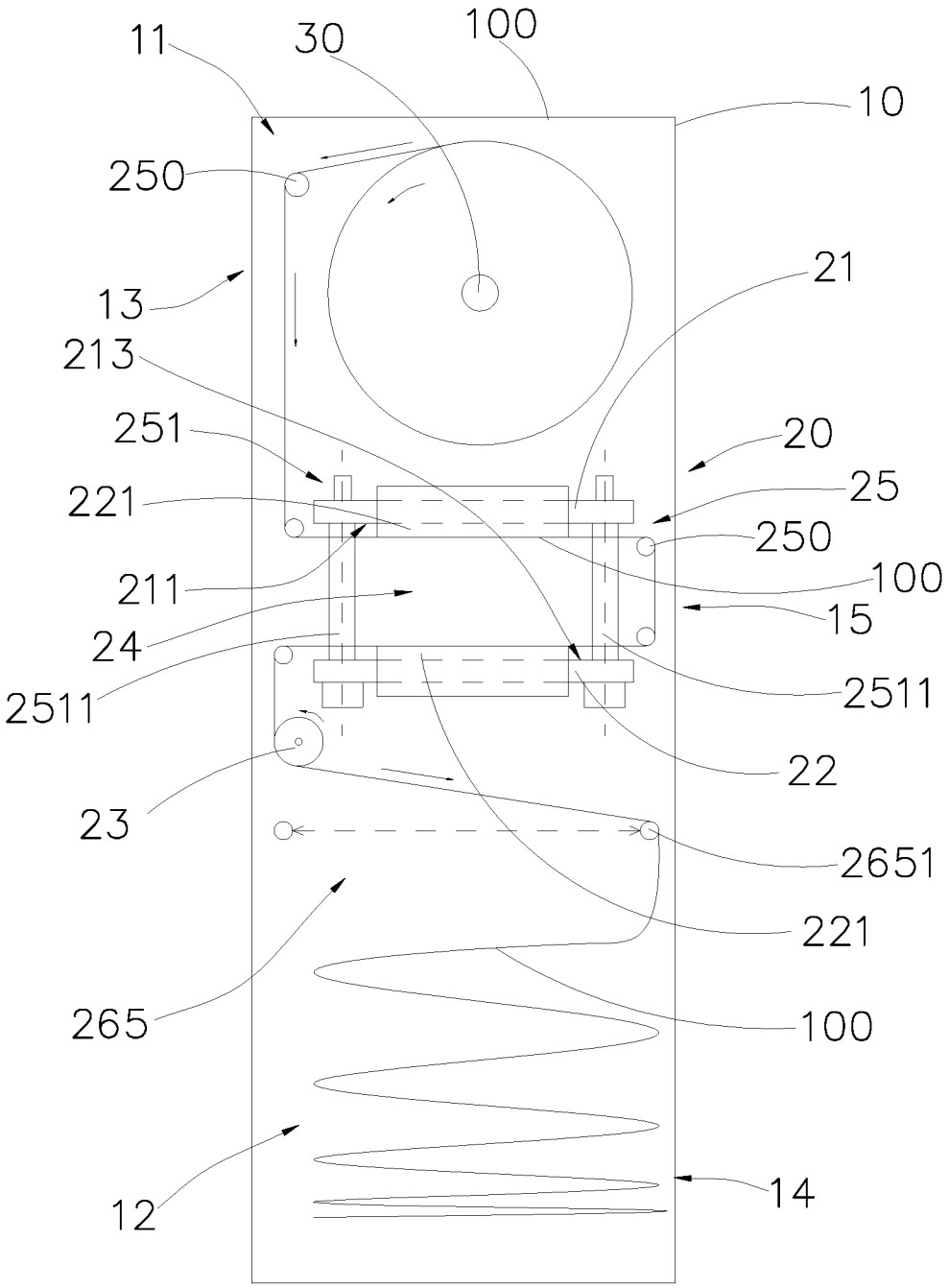
FIG. 2 is a schematic view of the hand drying apparatus according to a preferred embodiment of the present invention.
Figure 3:
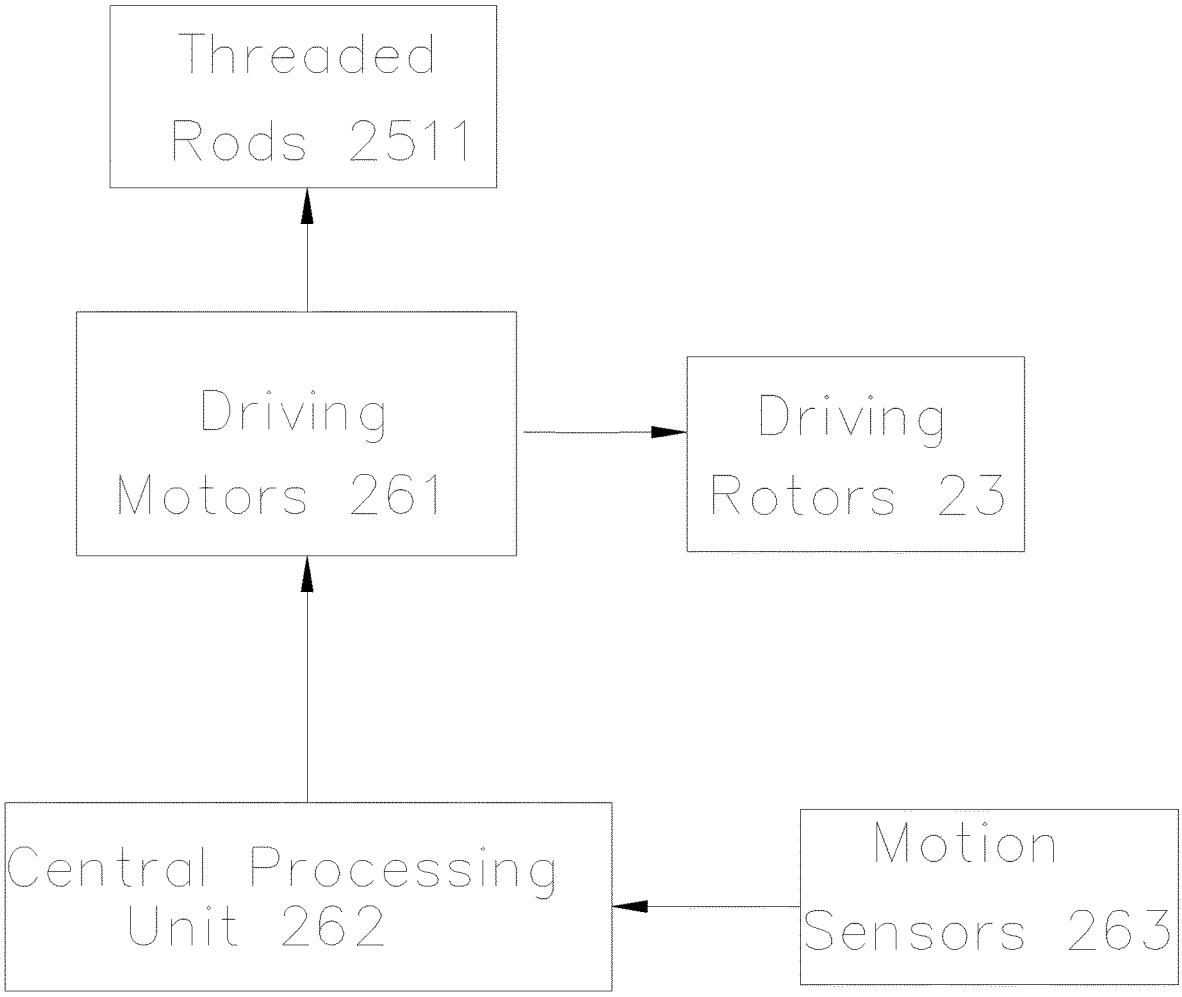
FIG. 3 a block diagram of a squeezing and dispensing arrangement of the hand drying apparatus according to the preferred embodiment of the present invention.

Referring to FIG. 1 to FIG. 3 of the drawings, a hand drying apparatus according to a preferred embodiment of the present invention is illustrated. Broadly, the hand drying apparatus may comprise an outer case 10 and a squeezing and dispensing arrangement 20. The hand drying apparatus may be configured for a fabric sheet 100 used for absorbing moisture from a user's hand. The fabric sheet 100 may be a sheet of paper towel or a sheet of fabric towel.

The squeezing and dispensing arrangement 20 may comprise at least a first supporting panel 21 provided in the outer case 10 and a second supporting panel 22 provided in the outer case 10, at least one driving rotor 23, and a plurality of supporting members 250. The second supporting panel 22 may be provided in the outer case 10 at a position spaced apart from the first supporting panel 21 to form at least one drying cavity 24 as a space formed between the first supporting panel 21 and the second supporting panel 22 for accommodating the user's hand.

The driving rotor 23 may be rotatably supported in the outer case 10 for driving the fabric sheet 100 to move in a predetermined direction in the outer case 10.

The squeezing and dispensing arrangement 20 may further comprise a plurality of supporting members 250 provided in the outer casing 10 and positioned to support the fabric sheet 100 between the first supporting panel 21 and the second supporting panel 22 in a slidably movable manner.

The hand drying apparatus may be operated between an idle mode and a drying mode, wherein in the idle mode, the first supporting panel 21 and the second supporting panel 22 are positioned and retained to space apart from each other, wherein in the drying mode, at least one of the first supporting panel 21 and the second supporting panel 22 is driven to move toward the other supporting panel 21(22) for allowing the fabric sheet 100 supported on the first supporting panel 21 and the second supporting panel 22 to contact with the user's hand in the drying cavity 24 so as to absorb moisture from the user's hand.

According to the preferred embodiment of the present invention, the hand drying apparatus of the present invention may utilize the fabric sheet 100 as a medium for absorbing moisture from the user's hands. Preferably, the fabric sheet 100 may be configured as fabric towel. Alternatively, paper towel may also be used. The fabric sheet 100 may therefore need to possess a predetermined amount of water absorbing ability so that when the fabric sheet 100 is in contact with the users' hands, water on the users' hands may be absorbed by the fabric sheet 100. The fabric sheet 100 may be folded or rolled to be continuously supplied to the squeezing and dispensing arrangement 20.

The outer case 10 may have a storage compartment 11 for storing cleaned, unused fabric sheet 100, and a collecting compartment 12 for storing used fabric sheet 100. The fabric sheet 100 may be guided to controllably move from the storage compartment 11 to the collecting compartment 12 through the squeezing and dispensing arrangement 20. In this preferred embodiment, the storage compartment 11 may be provided on an upper portion 13 of the outer case 10, while the collecting compartment 12 may be provided on a lower portion 14 of the outer case 10. The squeezing and dispensing arrangement 20 may be provided between the storage compartment 11 and the collecting compartment 12 at a mid portion 15 of the outer case 10.

The hand drying apparatus may further comprise a towel guider 30 provided in the storage compartment 11 for unused fabric sheet 100 to be supported thereon. In this preferred embodiment, the fabric sheet 100 may be configured as a roll which is to be supported on the towel guider 30 in the storage compartment 11. A certain amount of the fabric sheet 100 may be pulled out from the roll and fed to the squeezing and dispensing arrangement 20. As such, the squeezing and dispensing arrangement 20 may have a continuous supply of fabric sheet 100. The towel guider 30 may be configured as a roller (which may also be driven to move by the driving motor 261) or a stationary bar affixed in the storage compartment 11 of the outer case 10.

The outer case 10 may further have an access opening 161 provided on the outer case 10 for allowing a user to access the drying cavity 24 through the access opening 161. Thus, the access opening 161 may be formed at a position corresponding to that of the drying cavity 24 so that a user may be able to put his or her hand in the drying cavity through penetrating the access opening 161. Note that the number of drying cavities 24 and the access openings 161 may be varied according to an actual configuration of the present invention. Some of these configurations will be described below.

The driving rotor 23 may be distributed in the outer case 10 in a rotatably movable manner for driving the fabric sheet 100 to move in a predetermined path dictated by the spatial distribution of the driving rotor 23 and the supporting members 250. The objective is to guide the fabric sheet 100 to move from the storage compartment 11 and pass through the drying cavity 24 and to be finally in the collecting compartment 12. Referring to FIG. 2 of the drawings, the driving rotor 23 may be arranged to support a portion of the fabric sheet 100 so that when the driving rotor 23 rotates, the fabric sheet 100 may be driven to move in the direction of rotation of the driving rotor 23. It is worth mentioning that the fabric sheet 100 may be supported on the driving rotor 23 and the supporting members 250 in a stretched manner so as to maintain a predetermined tension on the fabric sheet 100 when it is traveled along the driving rotor 23 and the supporting members 250.

Specifically, at least two of the supporting members 250 may be provided in outer case 10 in such a manner that a portion of unused fabric sheet 100 may extend above the first supporting panel 21 and the second supporting panel 22. It is important to point out that the exact number of driving rotor 23 and the supporting members 250 employed in the outer case 10 may depend on the exact configuration of the outer case 10, and the desirable travel path of the fabric sheet 100.

The supporting members 250 may be mounted in the outer case 10 for supporting the fabric sheet 100 in a tensioned manner. The supporting members 250 may be stationary or rotatably mounted in the outer case 10. The purpose of the supporting members 250 is to guide and support the fabric sheet 100 to travel in a predetermined direction as driven by the driving rotor 23. The exact number of the supporting members 250 may depend on the exact configuration of the outer case 10, and the desirable travel path of the fabric sheet 100. For example, as shown in FIG. 2 of the drawings, two supporting members 250 may be mounted near two ends of the first supporting panel 21 respectively, while other two supporting members 250 may be mounted near two ends of the second supporting panel 22 respectively, wherein the fabric sheet 100 may be guided to extend on the first supporting panel 21 and the second supporting panel 22 so as to form a U-shaped configuration or contour of the fabric sheet 100.

The first supporting panel 21 and the second supporting panel 22 may be mounted in the outer case 10 for providing supports to the fabric sheet 100 and the user's hand. Each of the first supporting panel 21 and the second supporting panel 22 may be securely mounted in the outer case 10. Alternatively, at least one of the first supporting panel 21 and the second supporting panel 22 may be movably mounted in the outer case 10. The movement of the first supporting panel 21 and/or the second supporting panel 22 may be actuated by a driving mechanism 25 described below. In the preferred embodiment of the present invention, the second supporting panel 22 is securely and immovably provided in the outer case 10 while the first supporting panel 21 may be movably mounted in the outer case 10 to move toward or away from the second supporting panel 22. As shown in FIG. 2 of the drawings, the first supporting member 21 may be provided above the second supporting panel 22.

It is also worth mentioning that the second supporting panel 22 may be mounted or connected in the outer case 10 as a separate element. Alternatively, the second supporting panel 21 may also be integrally formed on the outer case 10 so that the outer case 10 and the second supporting panel 22 form an integral signal component. From manufacturing perspective, the outer case 10 and the second supporting panel 22 may be formed together as a whole without external connection or mounting.

The squeezing and dispensing arrangement 20 may further comprise a driving mechanism 25 provided in the outer case 10 for driving at least one of the first supporting panel 21 and the second supporting panel 22 to move toward the other supporting panel 21(22). In this preferred embodiment, the first supporting panel 21 may be positioned above the second supporting panel 22 wherein the driving mechanism 25 may be configured to drive the first supporting panel 21 to move toward the second supporting panel 22 so as to adjust the size and volume of the driving cavity 24.

The driving mechanism 25 may comprise a driving assembly 251 attached to the first supporting panel 21 for driving the first supporting panel 21 to move toward the second supporting panel 22. In this preferred embodiment, the driving assembly 251 may be configured as comprising two threaded rods 2511 (but at least one) connected to the first supporting panel 21 and the second supporting panel 22 in such a manner that when the threaded rods 2511 is driven to rotate, the first supporting panel 21 is arranged to move along a longitudinal direction of the threaded rod 2511. The second supporting panel 22 may remain stationary in the outer case 10.

The squeezing and dispensing arrangement 20 may further comprise at least one deformable pad 221 supported on one of the first supporting panel 21 and the second supporting panel 22 for supporting the user's hand. In this preferred embodiment, the squeezing and dispensing arrangement 20 may comprise two deformable pads 221 supported on the first supporting panel 21 and the second supporting panel 22 respectively. When the user's hand rest on the second supporting panel 22, one of the deformable pads 221 may slightly deform due to the hand's weight. Further deformation may occur when the first supporting panel 21 is driven to depress on the user's hand. Moreover, the deformable pad 221 on the first supporting panel 21 may also deform due to the pressure exerted by the first supporting panel 21. The slight deformation may allow the fabric sheet 100 to deform slightly so as to absorb moisture from the user's hand. Each of the deformable pads 221 may be configured from soft or foam material such as memory foam. Thus, one of the deformable pads 221 may be supported on an upper side 213 of the second supporting panel 22 while a portion of the fabric sheet 100 may be supported on the deformable pad 221. The other deformable pad 221 may be supported on the first supporting panel 21 while another portion of the fabric sheet 100 may be supported underneath the deformable pad 221. When the first supporting panel 21 is driven to move toward the second supporting panel 22, the corresponding portions of the fabric sheet 100 may come into contact with the user's hand.

As shown in FIG. 3 of the drawings, the squeezing and dispensing arrangement 20 may further comprise a plurality of driving motors 261 (but at least one) one of which is connected to the driving rotor 23 for driving the fabric sheet 100 to move along a path dictated by the distribution of the driving rotor 23. When the fabric sheet 100 is engaged with the driving rotor 23, the rotational movement of the driving rotor 23 may drive a particular portion of the fabric sheet 100 to move from the driving rotor 23 to a corresponding supporting member 250.

The squeezing and dispensing arrangement 20 may further comprise a central processing unit 262 electrically connected to the driving motors 261, and at least one motion sensor 263 provided in the drying cavity 24 and electrically connected to the central processing unit 262 for sensing presence of motion in the drying cavity 24. The central processing unit 262 may be programmed to control the operation of the driving motors 261 when signals from the motion sensor 263 are received. Some of the driving motors 261 may be connected to the driving assembly 251 for driving the threaded rods 2511 to rotate so as to drive the first supporting panel 21 to move toward the second supporting panel 22.

It is worth mentioning that used fabric sheet 100 may be moved to accommodate in the collecting compartment 12 which may be located underneath the squeezing and dispensing arrangement 20. When all the fabric sheet 100 has been used, the used fabric sheet 100 may be taken out for cleaning so that it may be re-accommodated in the storage compartment 11 and reused for drying in the manner described above.

The used fabric sheet 100 collected in the collecting compartment 12 may be freely stacked. Alternatively, the squeezing and dispensing arrangement 20 may further comprise a folding arrangement 265 which may comprise a folding rod 2651 moveably mounted in the collecting compartment 12 of the outer case 10 for folding used fabric sheet 100 into a folded stack. As shown in FIG. 2 of the drawings, the folding rod 2651 may move along a transverse direction of the outer case 10 so that when the used fabric sheet 100 move from the drying cavity 24 to the collection compartment 12, the used fabric sheet 100 may be guided to fold into a stack by the movement of the folding rod 2651.

The operation of the present invention may be as follows: when no object is in the drying cavity 24, the hand drying apparatus is idle. When a user wants to dry his hand, he may put his hands into the drying cavity 24 through the access opening 161. When his hands are in the drying cavity 24 and rest his hands on the fabric sheet 100 disposed on the deformable pad 221 and the second supporting panel 22, the motion sensor 263 may detect motion and send the corresponding signal to the central processing unit 262. The central processing unit 262 may then drive the corresponding driving motor 261 to rotate so as to actuate the driving assembly 251. The first supporting panel 21 may then be driven to move toward the second supporting panel 22 until the fabric sheet 100 supported on the first supporting panel 21 come into contact with the user's hands. The pressure exerted by the first supporting panel 21 may slightly depress the user's hand and squeeze the deformable pads 221 so as to allow the user's hands to be surrounded or wrapped by the fabric sheet 100.

The first supporting panel 21 may be configured to depress on the user's hand for a predetermined period of time. After the time lapses, the first supporting panel 21 may be driven to move away from the second supporting panel 22. At this time, the user may move his hands out of the drying cavity 24 through the access opening 161. It is worth mentioning that the central processing unit 262 may be configured to drive multiple squeezing motions (i.e. reciprocating movement) of the first supporting panel 21 with respect to the second supporting panel 22. This motion may again trigger the motion senor 263 and the corresponding signal may be sent to the central processing unit 262. The central processing unit 262 may be configured to drive the corresponding driving rotor 23 to rotate so as to drive the fabric sheet 100 to move along the path dictated by the distribution of the driving rotor 23. This allows the used fabric sheet 100 in the drying cavity 24 to be moved aside (and eventually moved to the collecting compartment 12) and replaced by unused fabric sheet 100 moved from the storage compartment 11. The hand drying apparatus may then become idle again and ready for next round of operation as mentioned above.

It is worth mentioning that the arrangement of the various components of the hand drying apparatus as described above may have several alternatives and variations. Some of these alternatives and variations may be described below. For example, the storage compartment 11, the collecting compartment 12 and the squeezing and dispensing arrangement 20 may be arranged and configured in a side-by-side manner (as opposed to up-and-down manner) so that fabric sheet 100 may travel from the storage compartment 11 sidewardly to the squeezing and dispensing arrangement 20 and eventually to the collecting compartment 12.

Moreover, the drying cavity 24 and the access opening 161 may be shaped and sized to form a horizontal orientation in the sense that a longitudinal axis of the drying cavity 24 may substantially parallel to horizontal. This configuration may be illustrated in FIG. 2 of the drawings. However, the drying cavity 24 may be shaped and sized to form a vertical orientation in the sense that a longitudinal axis of the drying cavity 24 may substantially parallel to vertical direction. The orientation of the drying cavity 24 and the access opening 161 may determine the orientation in which the user's hands are disposed in the drying cavity 24. The driving rotor 23, each of the supporting members 250, the folding rods 2651, and/or the towel guider 30 may be parallel to or perpendicular to a supporting surface (such as a wall surface or a ground surface) on which the hand drying apparatus may be supported. The configuration of the other components may also be adjusted accordingly.

Figure 4:
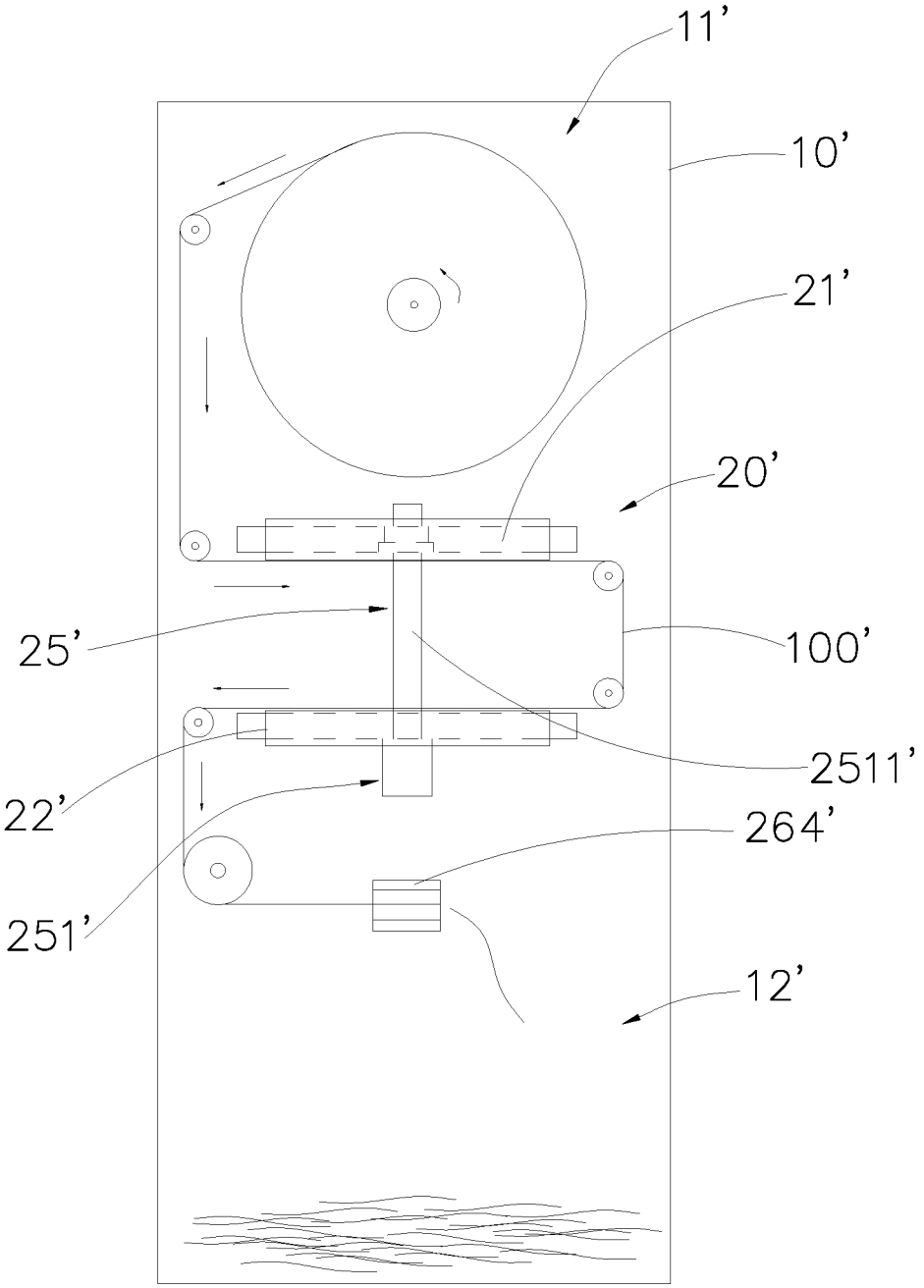
FIG. 4 is a first alternative mode of the hand drying apparatus according to the preferred embodiment of the present invention.

Referring to FIG. 4 of the drawings, a first alternative mode of the hand drying apparatus according to the preferred embodiment of the present invention is illustrated. The first alternative mode is similar to the preferred embodiment, except that the folding arrangement 265 described above may be replaced by a fabric cutter 264' and the driving mechanism 251'. According to the first alternative mode, the squeezing and dispensing arrangement 20' may further comprise a fabric cutter 264' provided in the outer case 10' at the collecting compartment 12' for selectively and controllably cutting used fabric sheet 100' into smaller pieces before being disposed in the collecting compartment 12'. When used fabric sheet 100' is cut into smaller pieces, the used fabric sheet 100' may be easily and periodically removed from the collecting compartment 12'. This helps to main hygienic condition in the hand drying apparatus. Unused fabric sheet 100' may be stored in the storage compartment 11'.

Figure 5:
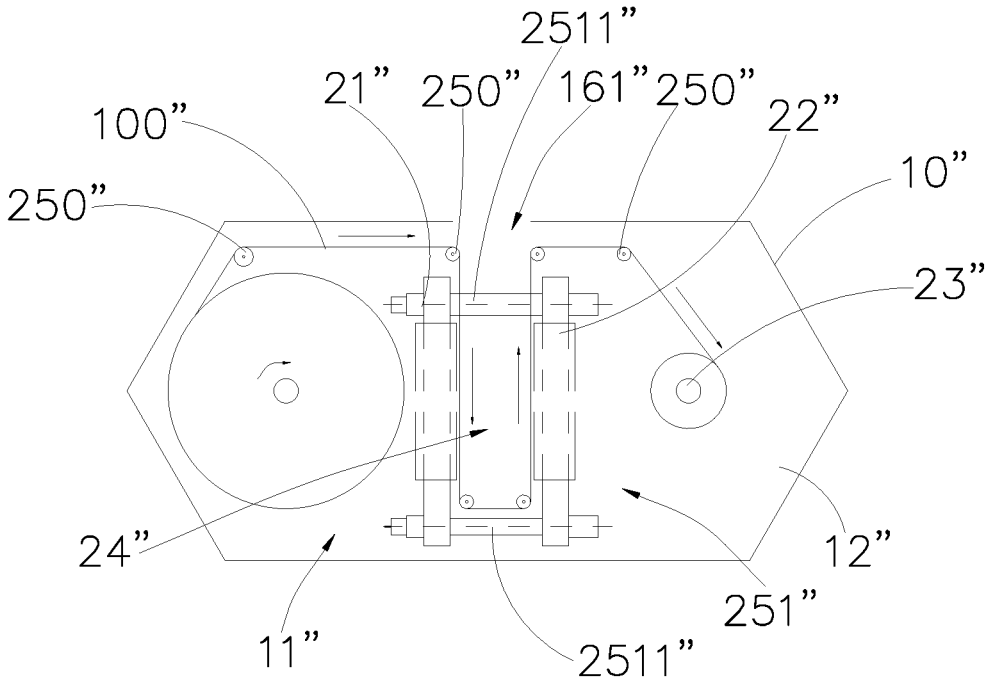
FIG. 5 is a second alternative mode of the hand drying apparatus according to the preferred embodiment of the present invention.

Referring to FIG. 5 of the drawings, a second alternative mode of the hand drying apparatus according to the preferred embodiment of the present invention is illustrated. The second alternative mode is similar to the preferred embodiment, except the configuration of the outer case 10". As shown in FIG. 5 of the drawings, the storage compartment 11", the squeezing and dispensing arrangement 20" and the collecting compartment 12" may be arranged in a side-by-side manner, in which the squeezing and dispensing arrangement 20" may be sandwiched between the storage compartment 11" and the collecting compartment 12". Unused fabric sheet 100" may be stored in the storage compartment 11" while used fabric sheet 100" may be collected in the collecting compartment 12". Driving rotors 23" and the supporting members 250" may also be provided in the outer case 10".

Moreover, the drying cavity 24" and the access opening 161" may be extended along a transverse axis of the outer case 10" while the first supporting panel 21" and the second supporting panel 22" may be formed on two sides of the drying cavity 24". Moreover, the driving assembly 251" may also be configured as comprising at least one threaded rod 2511" connected to the first supporting panel 21" and the second supporting panel 22".

According to the second alternative mode, at least one of the driving rotors 23" or the supporting member 250" may be provided in the collecting compartment 12" for retracting used fabric sheet 100" from the drying cavity 24". The folding arrangement 265 and the fabric cutter 264' are not employed in this second alternative mode.

Figure 6:
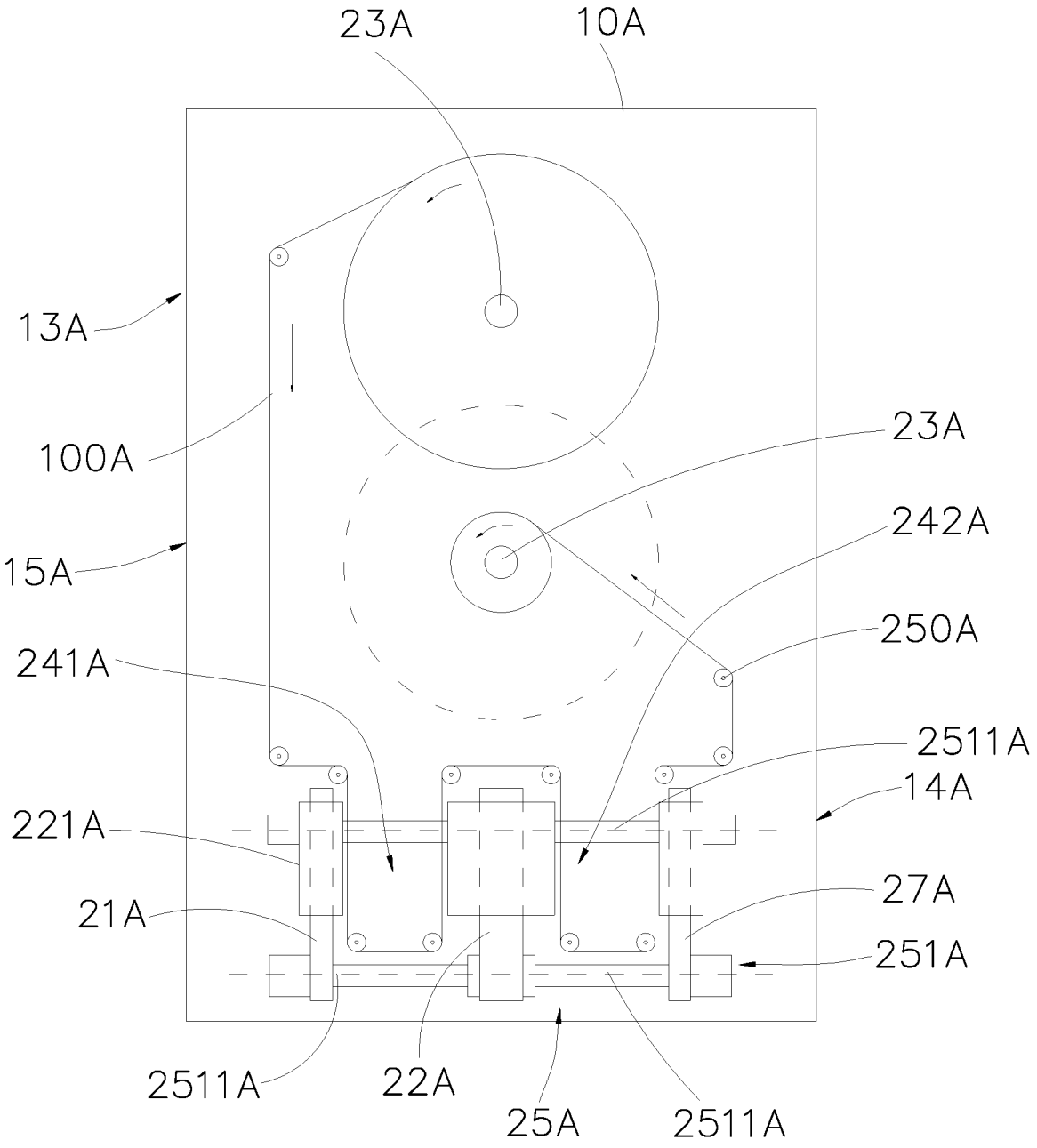
FIG. 6 is a third alternative mode of the hand drying apparatus according to the preferred embodiment of the present invention.

Referring to FIG. 6 of the drawings, a third alternative mode of the hand drying apparatus according to the preferred embodiment of the present invention is illustrated. The third alternative mode is similar to the preferred embodiment, except the number of drying cavities 24A and the configuration of the outer case 10A.

In the third alternative mode, the outer case 10A may have two drying cavities 24A for accommodating two hands of a user respectively. Accordingly, the squeezing and dispensing arrangement 20A may further comprise a third supporting panel 27A provided in the outer case 10A to form a first drying cavity 241A and a second drying cavity 242A. In this third alternative mode, the second supporting panel 22A may be stationary while the first supporting panel 21A and the third supporting panel 27A may be spacedly positioned at two opposed sides from the second supporting panel 22A. The first drying cavity 241A may be formed between the first supporting panel 21A and the second supporting panel 22A, while the second drying cavity 242A may be formed between the second supporting panel 22A and the third supporting panel 27A at a opposed side to the first supporting panel 21A.

With the presence of the third supporting panel 27A, the driving rotors 23A are distributed such that the fabric sheet 100A may sequentially pass through the first supporting panel 21A, the second supporting panel 22A, and the third supporting panel 27A. Moreover, in this third alternative mode, each of the first drying cavity 241A, the second drying cavity 242A, may be shaped and sized to form a vertical orientation in the sense that a longitudinal axis of the drying cavities 241A, 242A may substantially parallel to vertical direction with respect to the outer case 10A.

The driving assembly 251A of the driving mechanism 25A may further comprise a threaded rod 2511A so that at least two threaded rods 2511A may be used to actuate the first supporting panel 21A and the third supporting panel 27A respectively. Specifically, one of the threaded rods 2511A may operatively connect the first supporting panel 21A to the second supporting panel 22A so as to allow the first supporting panel 21A to selectively and controllably move toward the second supporting panel 22A. On the other hand, the other threaded rod 2511A may operatively connect the third supporting panel 27A to the second supporting panel 22A so as to allow the third supporting panel 27A to selectively and controllably move toward the second supporting panel 22A.

As a slight alternative, one threaded rod 2511A may extend across first through third supporting panel 21A, 22A, 27A so that a single threaded rob 251A may drive the first supporting panel 21A to move toward or away from the second supporting panel 22A, and to drive the third supporting panel 27A to move toward or away from the second supporting panel 22A. This may be accomplished by having the threaded rod 2511A to have two threaded sections.

Moreover, in the third alternative mode, the collecting compartment 12A may be formed at an upper portion 13A of the outer case 10A, the storage compartment 11A may be formed at the mid-portion 15A of the outer case 10A while the squeezing and dispensing arrangement 20A may be provided at the lower portion 14A of the outer case 10A. As in the second alternative mode, at least one of the driving rotors 23A or the supporting member 250A may be provided in the collecting compartment 12A for retracting used fabric sheet 100A from the drying cavity 24A.

Figure 7:
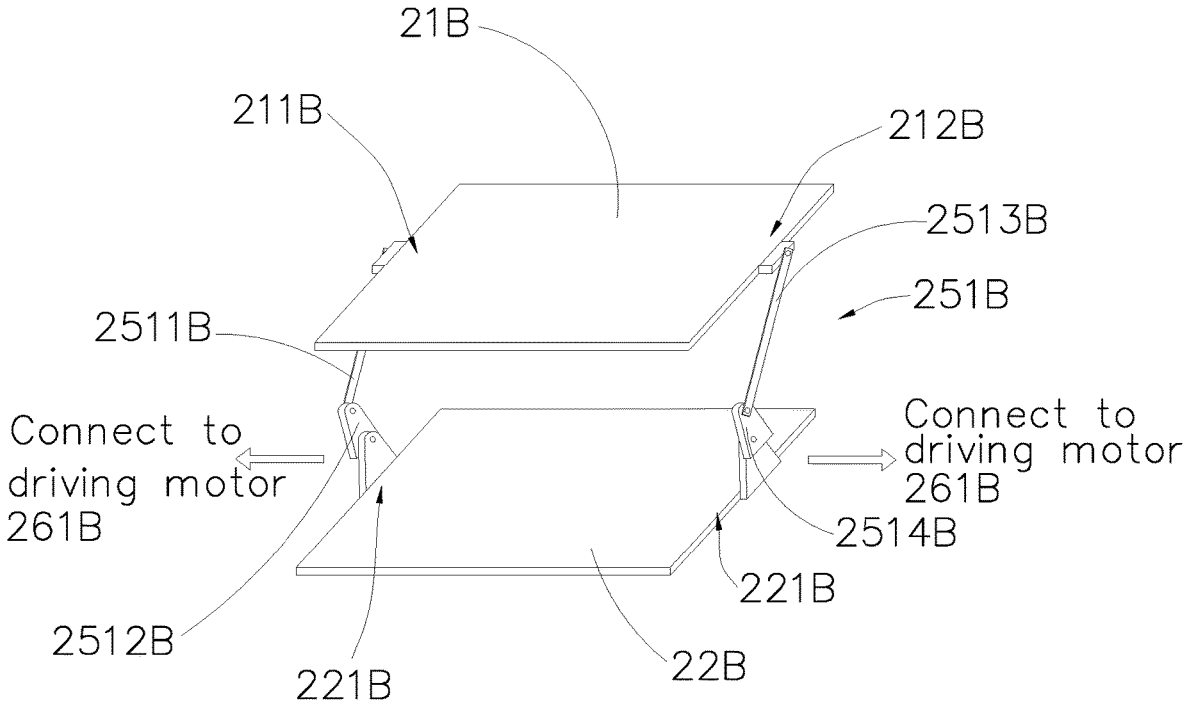
FIG. 7 is a fourth alternative mode of the hand drying apparatus according to the preferred embodiment of the present invention.

Referring to FIG. 7 of the drawings, a fourth alternative mode of the hand drying apparatus according to the preferred embodiment of the present invention is illustrated. The fourth alternative mode is similar to the preferred embodiment except the driving assembly 251B. According to the second alternative mode, the driving assembly 251B may comprise a plurality of connecting rods (but at least one) moveably mounted on the first supporting panel 21B and the second supporting panel 22B. As shown in FIG. 7 of the drawings, the driving assembly 251B may comprise first through fourth (but at least two) connecting rods 2511B, 2512B, 2153B, 2514B, wherein the first connecting rod 2511B and the second connecting rod 2512B are connected at one side of the first supporting panel 21B and the second supporting panel 22B, while the third connecting rod 2513B and the fourth connecting rod 2514B are connected to the other side of the first supporting panel 21B and the second supporting panel 22B.

The first connecting rod 2511B may have one end pivotally connected to a first side portion 211B of the first supporting panel 21B while the second connecting rod 2512B may also have one end pivotally connected to a corresponding first side portion 221B of the second supporting panel 22B. The other end of the first connecting rod 2511B may be pivotally connected to the other end of the second connecting rod 2512B.

Similarly, the third connecting rod 2513B has one end pivotally connected to the second side portion 212B of the first supporting panel 21B while the fourth connecting rod 2514B also has one end pivotally connected to a corresponding second side portion 222B of the second supporting panel 22B. The other end of the third connecting rod 2513B may be pivotally connected to the other end of the fourth connecting rod 2514B.

One of the driving motors 261B may be connected to the second connecting rod 2512B and one of the driving motors 261B may be connected to the fourth connecting rod 2514B so that when these two driving motors 261B are driven to rotate, the second connecting rod 2512B and the fourth connecting rod 2514B may be driven to pivotally move with respect to the second supporting panel 22B. These pivotal movements may drive the first connecting rod 2511B and the third connecting rod 2513B to move so as to drive the first supporting panel 21B to move toward the second supporting panel 22B. Thus, by controlling the driving movement of the corresponding driving motors 261B (such as the driving direction), the first supporting panel 21B may be driven to move toward or away from the second supporting panel 22B. The first supporting panel 21B and the second supporting panel 22B may be secured on the outer case 10 through two elongated slots provided on the outer case 10.

It is worth mentioning that when three supporting panels are utilized (such as the alternative described in the third alternative mode), the connection between the first supporting panel 21A and the second supporting panel 22A as described in this fourth alternative mode may also be applied to the connection between the second supporting panel 22A and the third supporting panel 27A.

Figure 8:
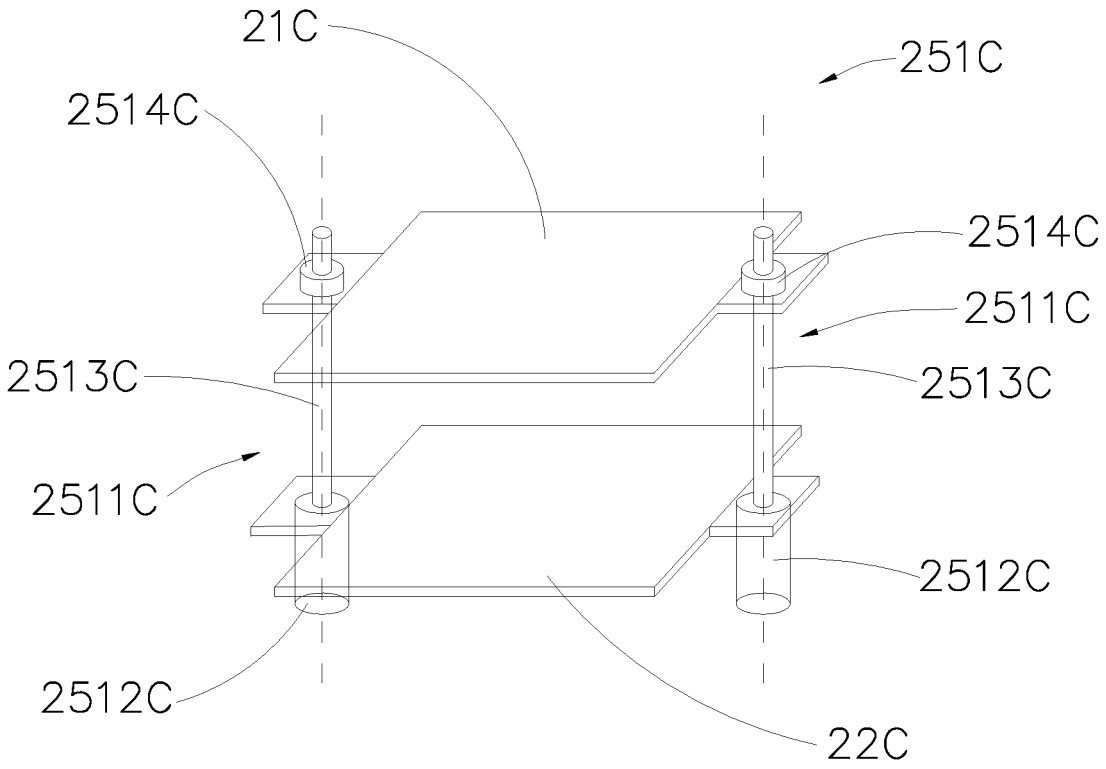
FIG. 8 is a fifth alternative mode of the hand drying apparatus according to the preferred embodiment of the present invention.

Referring to FIG. 8 of the drawings, a fifth alternative mode of the hand drying apparatus according to the preferred embodiment of the present invention is illustrated. The fifth alternative mode is similar to the preferred embodiment except the driving assembly 251C. According to the fifth alternative mode, the driving assembly 251C may comprise a plurality of (but at least one) pusher devices 2511C coupled between the first supporting panel 21C and the second supporting panel 22C for selectively and controllably driving the first supporting panel 21B toward and away from the second supporting panel 22C.

As shown in the exemplary configuration illustrated in FIG. 8 of the drawings, each of the pusher devices 2511C may be structurally identical. Each of the pusher devices 2511C may comprise a base 2512C connected to the second supporting panel 22C, and a pushing member 2513C movably extended from the base 2512C and connected to the first supporting panel 21C, in such a manner that when the pushing member 2513C extends or retracts with respect to the base 2512C, the second supporting member 22C may be driven to move away and toward the second supporting panel 22C respectively. The pushing member 2513C may be driven to move by pneumatic, hydraulic or electrical mechanisms. Each of the pusher devices 2511C may be connected to the central processing unit 262 so that the central processing unit 262 may selectively and controllably drive the pusher devices 2511C to operate so as to selectively and controllably drive the first supporting panel 21C to move toward or away from the second supporting panel 22C. Each of the pusher devices 2511C may further comprise a locking member 2514C for connecting the pushing member 2513C to the first supporting panel 21C.

Figure 9:
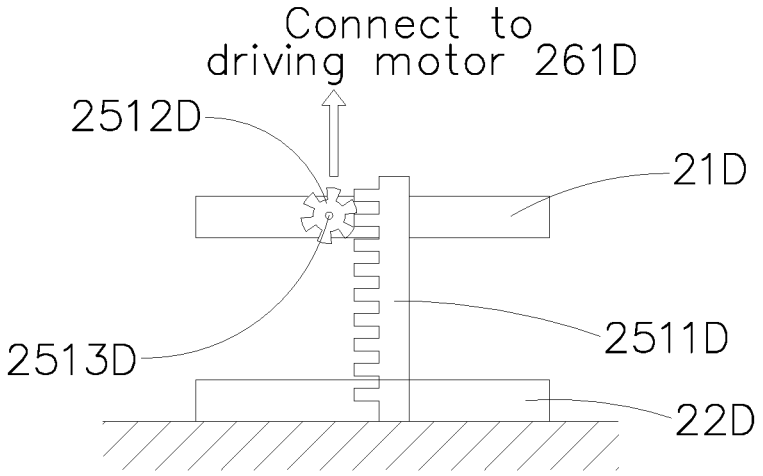
FIG. 9 is a sixth alternative mode of the hand drying apparatus according to the preferred embodiment of the present invention.

Referring to FIG. 9 of the drawings, a sixth alternative mode of the hand drying apparatus according to the preferred embodiment of the present invention is illustrated. The sixth alternative mode is similar to the preferred embodiment except the driving assembly 251D. According to the sixth alternative mode, the driving assembly 251D may comprise at least one rack and pinion gear provided in the outer case 10 at a position near one side of the first supporting panel 21D and the second supporting panel 22D. Specifically, the rack and pinion gear may comprise a rack gear 2511D mounted in the outer case 10 and a pinion gear 2512D operatively engaged with the rack gear 2511D in such a manner that when the pinion gear 2512D is driven to rotate, the rotational movement of the pinion gear 2512D may transform into a linear movement thereof along the rack gear 2511D. The driving assembly 251D may further comprise a driving shaft 2513D connected to the pinion gear 2512D and the first supporting panel 21D so that a linear movement of the pinion gear 2512D along a longitudinal direction of the rack gear 2511D may drive the first supporting panel 21D to move toward or away from the second supporting panel 22D. A driving motor 261D may be connected to the driving shaft 2513D for driving the driving shaft 2513D to rotate so as to controllably drive the corresponding pinion gear 2512D to move along the rack gear 2511D.

Note that the number of rack and pinion gears adopted in the hand drying apparatus may depend on the number of supporting panels and manufacturing circumstances of the present invention. For example, when only the first supporting panel 21D and the second supporting panel 22D are employed, two rack and pinion gears may be provided at two sides of the first supporting panel 21D and the second supporting panel 22D while two driving shafts 2513D may be connected between the two pinion gears 2512D and two corresponding sides of the first supporting panel 21D respectively.

Figure 10:
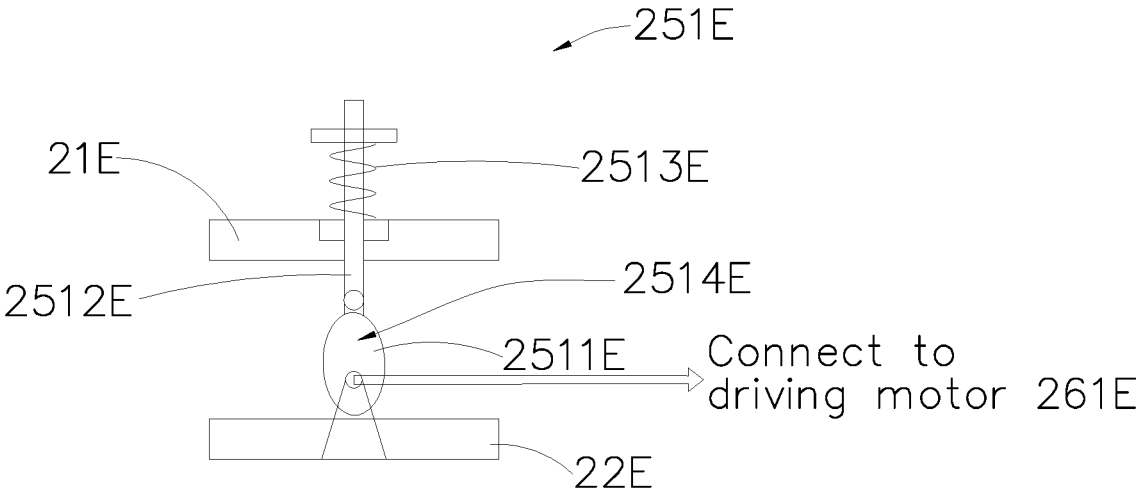
FIG. 10 is a seventh alternative mode of the hand drying apparatus according to the preferred embodiment of the present invention.

Referring to FIG. 10 of the drawings, a seventh alternative mode of the hand drying apparatus according to the preferred embodiment of the present invention is illustrated. The seventh alternative mode is similar to the preferred embodiment except the driving assembly 251E. According to the seventh alternative mode, the driving assembly 251E may comprise at least one driving wheel 2511E connected to a corresponding driving motor 261E, at least one connecting rod 2512E movably coupled to the first supporting panel 21E, and at least one resilient element 2513E connected to the connecting rod 2512E for normally exerting a biasing force against the first supporting panel 21E.

In the seventh alternative mode, the driving wheel 2511E may have a circular cross section or a having a bulging portion 2514E. The driving motor 261E may be eccentrically connected to the driving wheel 2511E so that when the driving wheel 2511E is driven to rotate, the connecting rod 2512E may be driven to move in a reciprocating manner so as to move the first supporting panel 21E toward or away from the second supporting panel 22E. Thus, by controlling the rotation of the driving wheel 2511E, the connection rod 2512E may be driven to move so as to move the first supporting panel 21E with respect to the second supporting panel 22E.

The driving assembly mentioned in the above alternative mode may also be applied when the squeezing and dispensing arrangement comprises two or three supporting panels. Any two of the supporting panels may also be driven by any one of the driving assemblies mentioned above.

The present invention, while illustrated and described in terms of a preferred embodiment and several alternatives, is not limited to the particular description contained in this specification. Additional alternative or equivalent components could also be used to practice the present invention.

What is claimed is:

1. A hand drying apparatus for a fabric sheet used for absorbing moisture from a user's hand, said hand drying apparatus comprising:

an outer case; and a squeezing and dispensing arrangement, which comprises:

at least a first supporting panel and a second supporting panel provided in said outer case, said second supporting panel being provided in said outer case at a position spaced apart from said first supporting panel to form at least one drying cavity as a space formed between said first supporting panel and said second supporting panel for accommodating said user's hand; and at least one driving rotor rotatably supported in said outer case for driving said fabric sheet to move in a predetermined direction; and a plurality of supporting members provided in said outer casing and positioned to support said fabric sheet between said first supporting panel and said second supporting panel in a slidably movable manner;

said hand drying apparatus being operated between an idle mode and a drying mode, wherein in said idle mode, said first supporting panel and said second supporting panel are positioned and retained to space apart from each other, wherein in said drying mode, at least one of said first supporting panel and said second supporting panel is driven to move toward said other supporting panel for allowing said fabric sheet supported on said first supporting panel and said second supporting panel to contact with said user's hand in said drying cavity so as to absorb moisture from said user's hand.

2. The hand drying apparatus, as recited in claim 1, wherein said squeezing and dispensing arrangement further comprise a driving mechanism provided in said outer case for driving at least one of said first supporting panel and said second supporting panel to move toward other of said first supporting panel and said second supporting panel.

3. The hand drying apparatus, as recited in claim 2, wherein at least two supporting members are mounted near two ends of each of said first supporting panel and said second supporting panel wherein said fabric sheet is guided to extend on said first supporting panel and said second supporting panel so as to form a U-shaped configuration of said fabric sheet in said drying cavity.

4. The hand drying apparatus, as recited in claim 3, wherein said squeezing and dispensing arrangement further comprise at least one deformable pad supported on one of said first supporting panel and said second supporting panel for supporting said user's hand.

5. The hand drying apparatus, as recited in claim 4, wherein said outer case further has an access opening for allowing a user to access said drying cavity through said access opening, said access opening being formed at a position corresponding to that of said drying cavity.

6. The hand drying apparatus, as recited in claim 3, wherein said driving mechanism comprises a driving assembly attached to said first supporting panel for driving said first supporting panel to move toward said second supporting panel, said driving assembly comprising at least one threaded rod connected to said first supporting panel and said second supporting panel in such a manner that when said threaded rod is driven to rotate, said first supporting panel is arranged to move along a longitudinal direction of said threaded rod.

7. The hand drying apparatus, as recited in claim 6, wherein said squeezing and dispensing arrangement further comprises a folding arrangement comprising a folding rod moveably mounted in said collecting compartment of said outer case for folding used fabric sheet into a folded stack, said folding rod being arranged to move along a corresponding direction of said outer case so that when said used fabric sheet moves from said drying cavity to said collection compartment, said used fabric sheet is guided to fold into a stack by said movement of said folding rod.

8. The hand drying apparatus, as recited in claim 6, wherein said driving assembly of said driving mechanism further comprises a threaded rod so that at least two threaded rods are used to actuate said first supporting panel and said third supporting panel respectively, one of said threaded rods operatively connecting said first supporting panel to said second supporting panel so as to allow said first supporting panel to selectively and controllably move toward and away from said second supporting panel, said other threaded rod operatively connecting said third supporting panel to said second supporting panel so as to allow said third supporting panel to selectively and controllably move toward and away from said second supporting panel.

9. The hand drying apparatus, as recited in claim 4, wherein said driving assembly comprises at least first through second connecting rods moveably mounted on said first supporting panel and said second supporting panel, wherein said first connecting rod and said second connecting rod are connected on said first supporting panel and said second supporting panel, said first connecting rod having one end pivotally connected to said first supporting panel while said second connecting rod having one end pivotally connected to said second supporting panel, said other end of said first connecting rod being pivotally connected to said other end of said second connecting rod.

10. The hand drying apparatus, as recited in claim 4, wherein said driving assembly comprises at least one pusher device coupled between said first supporting panel and said second supporting panel for selectively and controllably driving said first supporting panel toward and away from said second supporting panel, said pusher device comprising a base connected to said second supporting panel, and a pushing member movably extended from said base and connected to said first supporting panel, in such a manner that when said pushing member extends and retracts with respect to said base, said second supporting member is driven to move away and toward said second supporting panel respectively.

11. The hand drying apparatus, as recited in claim 4, wherein said driving assembly comprises at least one rack and pinion gear provided in said outer case at a position at one side of said first supporting panel and said second supporting panel, said rack and pinion gear comprises a rack gear supported in said outer case and a pinion gear operatively engaged with said rack gear in such a manner that when said pinion gear is driven to rotate, said rotational movement of said pinion gear is arranged to transform into a linear movement thereof along said rack gear, said driving assembly further comprising to a driving shaft connected to said pinion gear and said first supporting panel so that a linear movement of said pinion gear along a longitudinal direction of said rack gear is arranged to drive said first supporting panel to move toward or away from said second supporting panel.

12. The hand drying apparatus, as recited in claim 4, wherein said driving assembly comprises at least one driving wheel, at least one connecting rod movably coupled to said first supporting panel, and at least one resilient element connected to said connecting rod for normally exerting a biasing force against said first supporting panel, said driving wheel having a bulging portion so that when said driving wheel is driven to rotate, said connecting rod is also driven to move in a reciprocating manner so as to move said first supporting panel toward and away from said second supporting panel.

13. The hand drying apparatus, as recited in claim 6, wherein said outer case has a storage compartment for storing cleaned, unused fabric sheet, and a collecting compartment for storing used fabric sheet, said storage compartment being provided on an upper portion of said outer case, while said collecting compartment being provided on a lower portion of said outer case, said squeezing and dispensing arrangement being provided between said storage compartment and said collecting compartment at a mid portion of said outer case.

14. The hand drying apparatus, as recited in claim 6, wherein said collecting compartment is formed at an upper portion of said outer case, while said storage compartment is formed at said mid-portion of said outer case, and said squeezing and dispensing arrangement is provided at said lower portion of said outer case.

15. The hand drying apparatus, as recited in claim 13, wherein said first supporting panel is positioned above said second supporting panel in said outer case, wherein said driving mechanism is configured to drive said first supporting panel to move toward or away from said second supporting panel so as to adjust a size and a volume of said driving cavity.

16. The hand drying apparatus, as recited in claim 14, wherein said first supporting panel is positioned above said second supporting panel in said outer case, wherein said driving mechanism is configured to drive said first supporting panel to move toward or away from said second supporting panel so as to adjust a size and a volume of said driving cavity.

17. The hand drying apparatus, as recited in claim 6, wherein said storage compartment, said collecting compartment and said squeezing and dispensing arrangement being arranged and configured in a side-by-side manner so that said fabric sheet is arranged to travel from said storage compartment sidewardly to said squeezing and dispensing arrangement and sidewardly to said collecting compartment.

18. The hand drying apparatus, as recited in claim 13, wherein said outer case has two drying cavities for accommodating two hands of a user respectively, said squeezing and dispensing arrangement further comprising a third supporting panel provided in said outer case to form a first drying cavity and a second drying cavity, said second supporting panel being arranged to be stationary while said first supporting panel and said third supporting panel being spacedly positioned at two opposed sides from said second supporting panel, said first drying cavity being provided between said first supporting panel and said third supporting panel, while said second drying cavity being provided between said second supporting panel and said third supporting panel.

19. The hand drying apparatus, as recited in claim 14, wherein said outer case has two drying cavities for accommodating two hands of a user respectively, said squeezing and dispensing arrangement further comprising a third supporting panel provided in said outer case to form a first drying cavity and a second drying cavity, said second supporting panel being arranged to be stationary while said first supporting panel and said third supporting panel being spacedly positioned at two opposed sides from said second supporting panel, said first drying cavity being provided between said first supporting panel and said third supporting panel, while said second drying cavity being provided between said second supporting panel and said third supporting panel.

20. The hand drying apparatus, as recited in claim 17, wherein said outer case has two drying cavities for accommodating two hands of a user respectively, said squeezing and dispensing arrangement further comprising a third supporting panel provided in said outer case to form a first drying cavity and a second drying cavity, said second supporting panel being arranged to be stationary while said first supporting panel and said third supporting panel being spacedly positioned at two opposed sides from said second supporting panel, said first drying cavity being provided between said first supporting panel and said third supporting panel, while said second drying cavity being provided between said second supporting panel and said third supporting panel.

21. The hand drying apparatus, as recited in claim 13, wherein said drying cavity and said access opening are shaped and extend substantially along at least one of horizontal axis and vertical orientation of said outer case.

22. The hand drying apparatus, as recited in claim 14, wherein said drying cavity and said access opening are shaped and extend substantially along at least one of horizontal axis and vertical orientation of said outer case.

23. The hand drying apparatus, as recited in claim 17, wherein said drying cavity and said access opening are shaped and extend substantially along at least one of horizontal axis and vertical orientation of said outer case.

24. The hand drying apparatus, as recited in claim 20, wherein said drying cavity and said access opening are shaped and extend substantially along at least one of horizontal axis and vertical orientation of said outer case.

* * * * *